US007214113B2

(12) United States Patent
Kojima

(10) Patent No.: US 7,214,113 B2
(45) Date of Patent: May 8, 2007

(54) STEERING HANDLE FOR OUTBOARD MOTOR

(75) Inventor: Akiko Kojima, Shizuoka-ken (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 11/123,969

(22) Filed: May 6, 2005

(65) Prior Publication Data

US 2005/0266742 A1 Dec. 1, 2005

(30) Foreign Application Priority Data

May 7, 2004 (JP) ..... 2004-139264

(51) Int. Cl.
*B60W 10/04* (2006.01)

(52) U.S. Cl. ..... 440/87

(58) Field of Classification Search ..... 440/53, 440/84–87; 74/480 B
See application file for complete search history.

(56) References Cited

U.S. PATENT DOCUMENTS

| | | | | |
|---|---|---|---|---|
| 3,586,810 | A * | 6/1971 | Brown | 200/302.2 |
| 4,337,053 | A * | 6/1982 | Stevens | 440/87 |
| 5,180,320 | A * | 1/1993 | Calamia et al. | 440/61 R |
| 5,378,178 | A * | 1/1995 | Haman | 440/53 |
| 5,476,402 | A * | 12/1995 | Nakai et al. | 440/88 R |
| 6,406,342 | B1 * | 6/2002 | Walczak et al. | 440/84 |
| 6,902,450 | B2 * | 6/2005 | Ohtsuki et al. | 440/63 |
| 6,918,803 | B2 * | 7/2005 | Shomura | 440/88 A |

* cited by examiner

*Primary Examiner*—Ed Swinehart
(74) *Attorney, Agent, or Firm*—Knobbe, Martens, Olson & Bear LLP

(57) ABSTRACT

A steering handle assembly for an outboard motor has a low speed control switch with at least one lead wire that is not twisted during control of the watercraft. The low speed control switch provides precise control of the engine speed of the outboard motor. The steering handle assembly has a handle with an elongated handle body. The handle body is connected to the outboard motor. A grip is rotatably mounted to a distal end of the handle body and is rotatable about the axis of the handle body.

20 Claims, 6 Drawing Sheets

STEERING HANDLE FOR OUTBOARD MOTOR

PRIORITY CASES

The present application is based on and claims priority under 35 U.S.C. § 119(a–d) to Japanese Patent Application No. 2004-139264, filed on May 7, 2004, the entire contents of which is expressly incorporated by reference herein.

BACKGROUND OF THE INVENTIONS

1. Field of the Inventions

The invention relates to a steering handle assembly for operating an outboard motor of watercraft and, more particularly, to a steering handle assembly having a low speed control switch for controlling the engine speed of the outboard motor.

2. Description of the Related Art

Watercraft vehicles, such as boats, are often powered by an outboard motor having an internal combustion engine. The outboard motor can be attached to the aft end of a hull of a watercraft. A steering handle can extend from the outboard motor. The handle is used to steer and control the engine speed of the outboard motor. The steering handle can include a handle body and a rotatable grip. The grip can be rotated to control the engine output. A shift lever for changing the mode of operation of an associated watercraft can be positioned on the handle body. For example, the shift lever can be used to switch between forward, reverse, and neutral modes of operation.

Japanese Patent Application No. 2000-186653 discloses an outboard motor that has an air intake system for controlling the amount of air delivered to the internal combustion engine. The air intake system can have a flow regulating mechanism positioned along a bypass passage. The bypass passage provides air to the combustion chambers of the outboard motor to control the engine output for a low engine speed during, for example, idling, trolling and the like.

As shown in Japanese Patent Application No. HEI 2002-14235, a conventional low speed control switch can be attached to the grip of the steering handle. Unfortunately, if a speed control switch is mounted on the rotatable grip of a steering handle, the low speed control switch and the grip rotate together causing twisting of a lead wire connected to the low speed control switch. The twisting of the lead wire can cause wear.

SUMMARY OF THE INVENTION

Accordingly, one aspect of the present invention is a steering handle assembly for an outboard motor that has an engine. The steering handle assembly comprises an elongated handle body that is connected to and is extending from the outboard motor. A grip is mounted to a distal end of the handle body and is rotatable about a longitudinal axis of the handle body. A shift lever is connected to the handle body. A low speed control switch is configured to selective selectively control the rotational speed of the engine operating at relatively low speeds. The low speed control switch is attached to the handle body.

Another aspect of the present invention is a steering handle assembly for an outboard motor having an engine. The steering handle assembly comprises a handle body that is connected to the outboard motor. The handle body has a distal end and a proximal end. A grip is rotatably mounted to the distal end of the handle body. A low speed control switch is configured to selectively control the rotational speed of the engine operating at relatively low speeds. The low speed control switch is attached to the handle body near and proximal of the grip.

In yet another aspect an outboard motor comprises a steering handle assembly and an engine including an engine body. The engine body cooperates with at least one reciprocating piston to define at least one combustion chamber. An induction system is configured to guide air to the combustion chamber through at least a pair of intake ports. At least one fuel injector is configured to inject fuel for combustion in the combustion chamber. The steering handle assembly comprises a handle body. The handle body has a distal end and a proximal end. A grip is rotatably mounted to the distal end of the handle body. A low speed control switch is configured to selectively control the rotational speed of the engine operating at relatively low speeds. The low speed control switch is attached to the handle body proximal of the grip.

BRIEF DESCRIPTION OF THE DRAWINGS

The above and other features, aspects and advantages of the present invention will now be described with reference to drawings that show preferred arrangements that are intended to illustrate and not to limit the present invention and in which drawings.

DETAILED DESCRIPTION OF THE PREFERRED EMBODIMENTS

Figure 1:
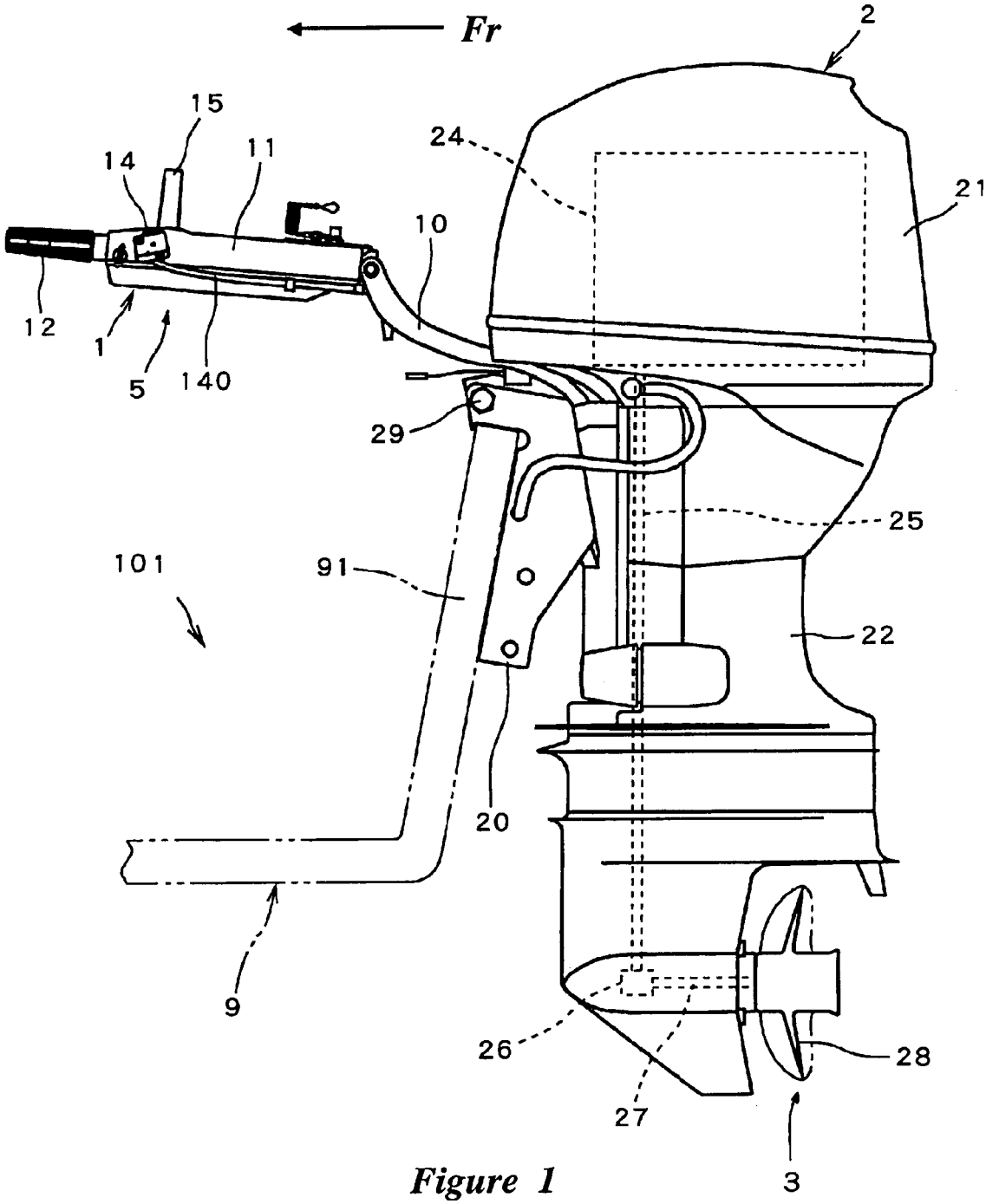
FIG. 1 is a side view of an outboard motor with a steering handle assembly.

FIG. 1 is a side view showing the overall construction of an outboard motor 2 having a steering handle assembly 5.

A watercraft 101 has a hull 9 that carries the outboard motor 2, which has a propulsion unit 3 and an internal combustion engine 24 (shown in phantom). The engine 24 of the outboard motor 2 powers the propulsion unit 3. The illustrated propulsion unit 3 is a single propeller system; however, other types of propulsion units can be used as well, such as, for example, a dual counter-rotational propeller system, a jet drive, and the like. The outboard motor 2 is supported on a transom plate 91 of the hull 9 by a clamp bracket 20 so as to place at least a portion of the propulsion unit 9 in a submerged position when the watercraft 101 rests in the water.

The outboard motor 2 is preferably steerable and/or tiltable by moving the clamp 20. The arrow FR in the drawing indicates the forward direction in which the watercraft 101 travels. The terms "proximal" and "distal" are used to describe the present outboard motor 2 and the steering handle assembly 5. The terms proximal and distal are used in reference to the engine 24 of the outboard motor 2. When the outboard motor 2 is in the illustrated position of FIG. 1, the distal direction corresponds to the forward direction.

The engine 24 is covered by a cowling 21 that is attached to a case 22. The illustrated case 22 is attached to the transom plate 91 of the hull 9 through the clamp bracket 20 for rotation about a tilt shaft 29. The engine 24 is preferably a multi-cylinder engine, such as a four-cycle engine. Engines having a different number of cylinders, other cylinder arrangements, various cylinder orientations (e.g., upright cylinder banks, and V-type), and operating on various combustion principles (e.g., four stroke, crankcase compression two-stroke, diesel, and rotary) are all practicable for use with the steering handle assemblies disclosed herein. The engine 24 can comprise an engine body defining at least one cylinder bore therethrough. A cylinder head assembly is connected to the cylinder bore, and a piston is disposed within the cylinder bore. The cylinder bore, the cylinder head assembly, and a piston cooperate to define a variable combustion chamber.

A crankshaft (not shown in the figure) of the engine 24 is generally vertically oriented with respect to the water surface. The crankshaft is connected to the upper end of a drive shaft 25 extending vertically through the case 22. The lower end of the drive shaft 25 is connected to a gear mechanism 26. The gear mechanism 26 can comprise a bevel gear, forward/reverse switching gears, a clutch and the like housed in the lower part of the case 22. A propeller shaft 27 extends generally horizontally from the gear mechanism 26. A switching mechanism can be used to switch between forward, neutral and reverse modes by changing the direction of rotation of the propeller 28. A propeller 28 is attached to the outer end of the propeller shaft 27, which protrudes outwardly from the case 22. The watercraft 101 is propelled as the propeller 28 is rotated in the water.

Figure 2:
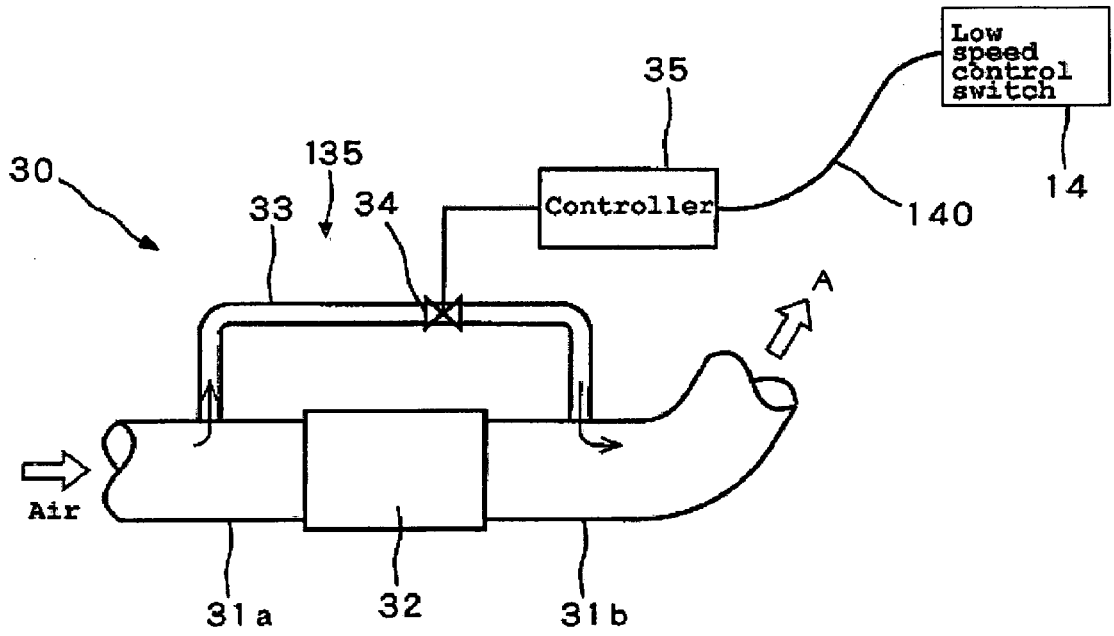
FIG. 2 is a schematic diagram of a portion of an air intake system positioned on an intake side of an engine of the outboard motor of FIG. 1.

The engine 24 can have an intake system that provides air to the engine's combustion chambers. Generally, the engine 24 can have an air intake system that draws air from outside the engine, preferably from within the cavity defined by the cowling 21 and the internal combustion 24, and delivers the air to the combustion chambers of the engine 24. As shown in FIG. 2, an air intake system 30 can comprise an air intake manifold, a throttle valve 32, a bypass system 135, and/or the like. The air intake system 30 can define an airflow pathway for communication between the atmosphere and the inside of the combustion chambers of the internal combustion engine 24. The air intake system 30 can selectively control the amount of air delivered to the combustion chambers to achieve the desired engine output. A fuel delivery system and the air intake system 30 cooperate to control the air/fuel mixture delivered to combustion chambers for the combustion process.

With continued reference to FIG. 2, the illustrated intake system 30 comprises the bypass system 135, an air intake pipe 31*a*, a throttle valve 32, and an air intake pipe 31*b*. The throttle valve 32 is positioned between the ends of the air intake pipes 31*a*, 31*b*. Thus, the air intake pipes 31*a*, 31*b* are positioned upstream and downstream, respectively, of the throttle valve 32. The arrows A indicate the direction of air flow through the air intake system 30. The grip 12 of the steering handle assembly 5 can be linked to the throttle valve 32 to open and close the throttle valve 32.

The bypass system 135 includes a bypass passage 33 that provides fluid communication between the air intake pipes 31*a*, 31*b* around the throttle valve 32. As used herein, the term "intake pipe" is to be construed broadly to include, without limitation, runners, conduits, pipes, passages, tubes, and other structures that air can flow through.

The illustrated bypass passage 33 branches from the intake pipe 31*a* and is connected to the air intake pipe 31*b*. When the engine runs at low engine speeds, the bypass passage 33 supplies air from the intake pipe 31*a* to the intake pipe 31*b* on the downstream side of the throttle valve 32. The bypass system 135 can selectively control the air flow through the air intake system 30 and to the combustion chambers when the throttle valve 32 is partially or fully closed. For example, the bypass system 135 can selectively control the flow of intake air to the engine 24 during idling, trolling, and/or other low engine speed operating conditions.

The bypass system 135 preferably comprises one or more valves. The illustrated bypass system 135 comprises an idle speed control ("ISC") valve 34. The ISC valve 34 can be any type of idle speed control valve or idle regulating valve suitable for controlling the air flow through the bypass passage 33. The ISC valve 34 can be mechanically or electrically operated by controller 35 and/or by the low speed control switch 14.

With continued reference to FIG. 2, the controller 35 (e.g., an ECU) can control directly or indirectly the ISC valve 34 to adjust the amount of intake air delivered to the engine during low engine speed operation. The controller 35 can control the operation of the ISC valve 34 based on one or more of the following: position of the shift lever, engine speed, operation of the low speed control switch 14 (preferably when the throttle is partially or fully closed), and the like. The bypass system 135 can decrease or limit the rotational fluctuations of the engine, especially at low rotational speeds, and may also prevent engine stalling.

Figure 3:
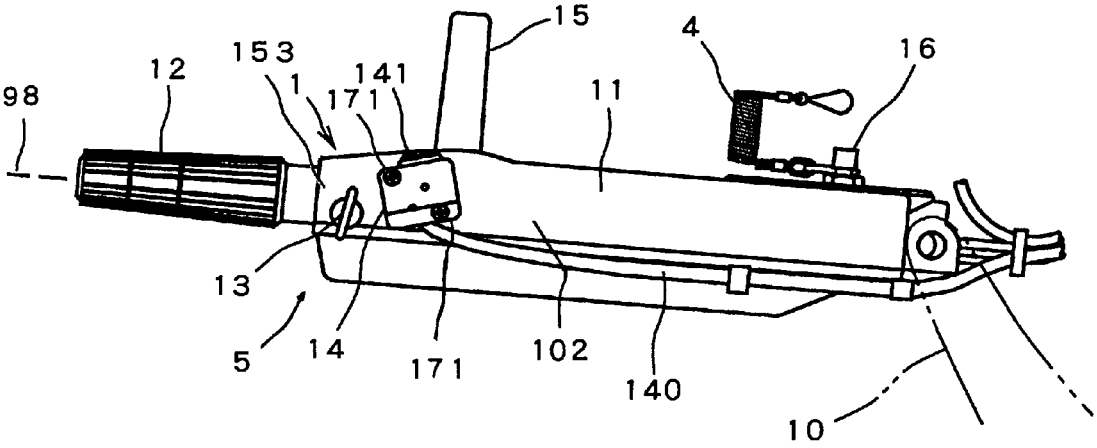
FIG. 3 is a side view of the steering handle assembly of FIG. 1.

With reference to FIGS. 1 and 3, the handle assembly 5 can be a tiller with a grip 12 and a low speed control switch 14. Generally, the grip 12 can be used to open and close throttle valve 32 to achieve a wide range of engine speeds (preferably a wide range of engine speeds, including planing engine speeds to relatively low engine speeds). The low speed control switch 14 can control the engine speed when the engine runs at a low speed (e.g., idle speed, trolling speed, and the like). Relatively low engine speeds are significantly less than engine speeds that cause the associated watercraft to plane. For example, relatively low engine speeds can be associated with displacement operating condition of the associated watercraft including when trolling. As used herein, the term "low rotational speed" is a broad term and is used in its ordinary meaning and includes, without limitation, engine speeds typical during idling, trolling, and the like. The terms "low rotational speed" and "low engine speed" are used interchangeably herein.

To run the engine at a trolling speed, the grip 12 can be rotated or released to close the throttle valve 32. When the throttle valve 32 is closed, the bypass system 135 can deliver a sufficient amount of air to the engine 24 for low engine speeds. The low speed control switch 14 can adjust the amount of air the bypass system 135 delivers to the engine, such that the engine operates at a low speed. Thus, both the grip 12 and the low speed control switch 14 can be used to control the engine speed; however, the low speed control switch 14 provides precise control of the engine at low engine speeds, whereas the grip 12 provides control of the engine speed for planing and transition engine speeds.

With reference to FIG. 1, the handle assembly 5 extends distally from the outboard motor 2 and includes a handle 1 that is generally horizontally orientated. The handle 1 is rotatably attached to the hull 9 via a steering bracket 10 of the handle assembly 5. The steering bracket 10 extends between the handle 1 and the clamp bracket 20, or other suitable portion of the outboard motor 2 such that the rotation of the handle assembly 5 causes corresponding rotation of the outboard motor 2. Thus, the handle assembly 5 can be used to rotate the outboard motor 2 about a vertical axis to steer the watercraft 101.

A grip 12 is disposed at the distal end of the steering handle 1 and is configured to selectively control the throttle operation for the engine 24. The illustrated grip 12 is rotatable about an axis (e.g., the longitudinal axis 98 of the grip 12) to control the engine speed. The longitudinal axis 98 of the grip 12 can be somewhat parallel to the longitudinal axis of the steering handle 1. The rotation of the grip 12 is transmitted to the control mechanism of the throttle valve 32 through a shaft, which is preferably housed inside the steering handle 1, to adjust the amount of intake air delivered to the engine 24. In some embodiments, a shaft extends between the grip 12 and a pulley. The grip 12 and associated shaft can be rotated to cause rotation of the pulley. A cable connects the pulley to the throttle valve 32. The cable can drive a throttle shaft of the throttle valve 32 to cause movement of a throttle valve plate of the throttle valve 32. Thus, the grip 12 can be rotated in one direction to increase engine output and rotated in the other direction to decrease engine output.

The grip 12 can have an outer surface that provides a comfortable gripping surface. The grip 12 can be made of a synthetic or natural material. For example, the grip can comprise synthetic or natural foam, resins, polymers, plastics, and the like. The grip 12 can be textured or have irregularities on its surface to increase frictional interaction with the hand of the user. The operator can face the forward direction, such that the operator's back is facing the outboard motor 2, and can hold the grip 12 of the steering handle assembly 5 with his hand.

With continued reference to FIGS. 1 and 3, the handle 1 preferably has an elongated handle body 11. The handle body 11 can be formed of a metal, such as cast or extruded aluminum alloy. The grip 12 is pivotally mounted to a distal end 153 of the handle body 11. The grip 12 can be rotated about its longitudinal axis 98 relative to the handle body 11. That is, the handle body 11 does not rotate about its longitudinal axis as the grip 12 is rotated about the longitudinal axis 98. Of course, the grip 12 and the handle body 11 can be rotated about a generally vertical axis to steer the watercraft 101.

A shift lever 15 is positioned along and attached to the steering handle 1. The steering handle 1 can be interposed between the shift lever 15 and the low speed control switch 14. The operator can use the shift lever 15 to select a forward, reverse, or neutral mode of engine operation.

Figure 4:
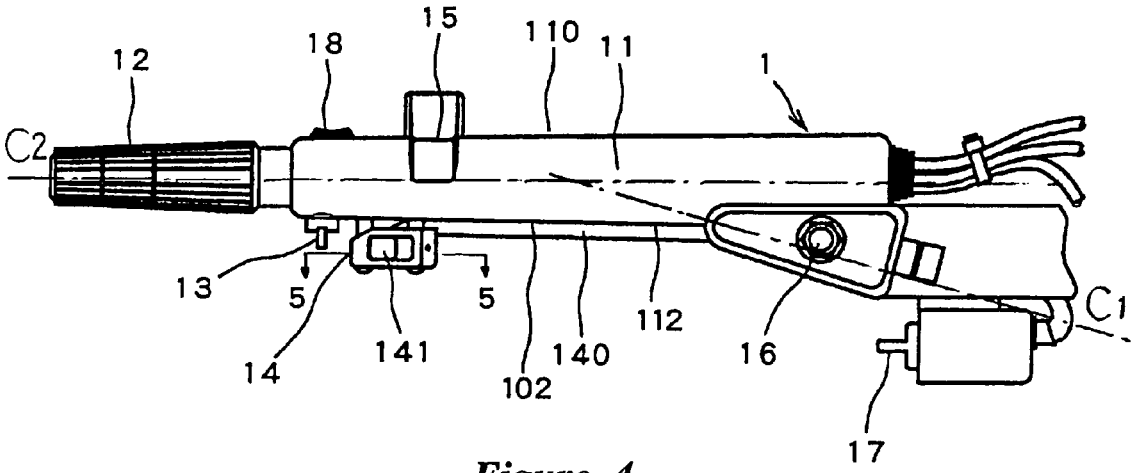
FIG. 4 is a top view of the steering handle assembly of FIG. 3.

The low speed control switch 14 is preferably positioned at some point along the handle body 11. In some embodiments, including the illustrated embodiment, at least a portion of the low speed control switch 14 is positioned between the grip 12 and the shift lever 15. The low speed control switch 14 extends outwardly from a side surface 102 of the handle body 11, as shown in FIGS. 3 and 4. At least a portion of the low speed control switch 14 is positioned between the shift lever 15 and the grip 12. In the illustrated embodiment, a substantial portion of the low speed control switch 14 is positioned distally of the shift lever 15 and is positioned proximally of the grip 12. As shown in FIG. 4, the low speed control switch 14 is offset from the longitudinal axis of the handle body 11. When the grip 12 is rotated about its longitudinal axis 98, the low speed control switch 14 does not rotate along with the grip. Thus, the lead wire 140 connected to the switch 14 does not twist due to the rotation of the grip 12. Additionally, because the low speed control switch 14 is positioned between the grip 12 and the shift lever 15, but near the grip 12, the operator can operate the low speed control switch 14 while engaging (e.g., holding or resting) the grip 12. If the operator's left hand rests on the grip 12, the operator's fingers can engage and operate the low speed control switch 14. The low speed control switch 14 is thus positioned near or next to the grip 12.

The low speed control switch 14 is connected to the controller 35 via the lead wires 140. The low speed control switch 14 can be operated to control the ISC valve 34. When the operator operates the low speed control switch 14, for example, the engine speed during trolling can be adjusted to obtain the desired engine output.

With reference to FIGS. 3 and 4, the handle body 11 has a cavity or passageway sized and configured to house the acceleration shaft, lead wires for switches, and/or the like. The handle body 11 extends distally from the steering bracket 10 to the grip 12. The low speed control switch 14 is attached to the side surface 102 of the handle body 11. When the operator steers the outboard motor 2, the handle body 11 is generally positioned between the speed control switch 14 and the operator.

The steering handle 1 of the handle assembly 5 can be pivoted about the bracket 20 to steer the watercraft 101. The steering handle 1 can be inclined upwardly in the distal direction. The low speed control switch 14 is preferably inclined downwardly in the distal direction with respect to the longitudinal axis of the steering handle 1.

Figure 5:
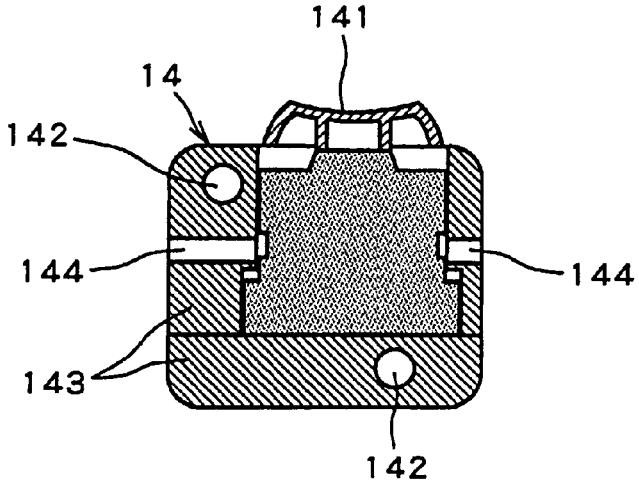
FIG. 5 is an enlarged sectional view of a low speed control switch of the steering handle assembly of FIG. 4 taken along line 5—5.

With reference to FIGS. 4 and 5, the low speed control switch 14 has an operating face 141 that faces upwardly and is generally oriented horizontally. As such, the operating face 141 can be visible for easy operation. The low speed control switch 14 comprises a switch housing 143. The operating face 141 can be movable with respect to the switch housing 143.

The housing 143 can includes one or more mounting holes 142 extending through the wall of the housing 143. Any number of mounting holes 142 can be positioned along the housing 143. The illustrated housing 143 has an upper mounting hole 142 and a lower mounting hole 142 through a wall of the housing. The low speed control switch 14 is attached to the handle body 11 by screws 171 (FIG. 3) disposed through the mounting holes 142. However, the switch housing 143 can be attached to the handle body 11 by welding, one or more rivets, nut and bolt assemblies, and/or other suitable means for coupling the switch housing 143 to the handle body 11.

One or more lead wires 140 connect the controller 35 (FIG. 2) and the low speed control switch 14. The illustrated steering handle assembly 5 has a single lead wire 140 that extends between the low speed control switch 14 and the controller 35. The lead wire 140 is preferably covered by a waterproof material, such as a protective waterproof polymer covering. In some embodiments, at least a portion of the lead wire 140 is disposed inside the handle body 11. For example, a substantial portion of the lead wire 140 can be disposed inside of the handle body 11. The handle body 11 can have an internal passageway and the lead wire can extend therethrough. In other embodiments, the lead wire 140 is positioned outside of the handle body 11. For example, the lead wire 140 can be coupled to the outside surface of the handle body 11.

The low speed control switch 14 is used to open and close the ISC valve 34. As shown in FIGS. 3 and 4, the low speed control switch 14 can comprise a rocker or tumbler switch that can be pressed in a seesaw manner. One end of the switch 14 can be depressed or undepressed to increase or decrease the engine speed. Alternatively, the low speed control switch 14 can be a slide switch movable between one or more preset positions. Each position can correspond to an engine output.

In some embodiments, the low speed control switch 14 may allow ingress of water through a gap defined between operating face 141 and the housing 143. As shown in FIG. 5, the side surfaces and the bottom surface of the low speed control switch 14 can be covered and sealed by the housing 143. The housing 143 can have one or more drain holes 144 for permitting water egress. The illustrated housing 143 has side walls each having at least one drain hole 144 extending therethrough. Water can pass through the drain holes 144 to reduce or limit the amount of water collected within the switch 14, thus limiting the adverse effects of water. In other words, water that has entered the housing 143 of the switch 14 can be discharged out of the drain holes 144 to reduce or limit the water damage to the low speed control switch 14.

The illustrated handle assembly 5 has a throttle resistance switch 13 for selectively adjusting the force required to rotate the grip 12. The throttle resistance switch 13 can be used determine the required force to rotate the grip 12 about its longitudinal axis 98. The handle assembly 5 also includes a main switch 17 for starting the engine 24 and a stop switch 16. The stop switch 16 can be connected to the operator's arm via a strap or lanyard 4. Should an operator fall into the water, or is otherwise moved away from the outboard motor 2 by a preset distance, the strap 4 will pull away the strap switch 16 to stop the engine 24, as is well known in the art.

With respect to FIG. 4, the handle assembly 5 preferably has a positioning switch 18 for adjusting the position of the outboard motor 2. The positioning switch 18 can be a power trim and tilt switch for adjusting the tilt angle and the trim angle of the outboard motor 2. The power trim and tilt switch 18 preferably is disposed on the inner side 110 (i.e., on the operator side) of the steering handle 1. The low speed control switch 14 preferably is disposed on the outer side 112 of the steering handle 1. When the operator grips the handle assembly 5 and faces the forward direction, the handle assembly 5 preferably is angled with respect to the center line C1 of the outboard motor, as viewed from above. In this seating position, the operator can conveniently operate the low speed control switch 14 and the positioning switch 18.

Advantageously, the power trim and tilt switch 18 can be easily actuated while the engine is operating at planing and transition speeds because the power trim and tilt switch 18 is disposed on the inner side 110. The low speed control switch 14 is disposed on the opposite side of the handle 11 and can be easily actuated when the engine runs at a low speed. When the grip 12 is rotated to increase engine speed, the operator's hand is moved towards the trim and tilt switch 18. When the grip 12 is rotated in the opposite direction, the operator's hand is moved towards the low speed control switch 14. Therefore, the operator can perform trim operations without changing his seating posture and can operate the low speed control switch 14 at low engine speeds.

During operation, the grip 12 is preferably used to control the engine output when the engine runs at planing or transition engine speeds (e.g., engine speeds higher than idle or trolling speeds). However, the operator may not be able to use the grip 12 to precisely adjust the engine speed within low engine speed ranges (e.g., engine speeds for idling or trolling). When the engine is run at a low speeds (e.g., engine speeds suitable for trolling), the low speed switch 14 is used to precisely adjust (e.g., to increase or decrease) the engine speed. Thus, the grip 12 is preferably used to control the engine speed when the engine operates at mid or high engine speeds, while the low speed switch 14 is used to adjust the engine speed when the engine operates at a low engine speed. Of course, the grip 12 can be used to control the engine at low engine speeds; however, it may be difficult to use the grip 12 to obtain a particular low engine speed.

In some embodiments, the grip 12 can be rotated to open the throttle valve 32 a desired amount. When the throttle valve 32 is opened, air flows through the intake pipe 31*a*, a throttle valve 32, and the intake pipe 31*b*. For trolling speeds, the throttle valve 32 is closed and the bypass system 135 can be used to deliver air to the engine 24. When the trolling propulsion is started, the engine 24 can run at a preset speed (e.g., 700 rotations/minute). A controller 35 can have a preset target trolling speed. In some embodiments, the operator can change the target trolling speed.

The low speed switch 14 is used to adjust the air flow rate through the bypass system 135 to increase or decrease the engine speed from the preset speed. When the operator desires to increase or decrease the engine speed, the operator engages and moves the operating face 141 of the low speed control switch 14 to achieve the desired trolling speed. At higher engine speeds, the valve 34 can be closed and the throttle valve 32 can be opened by using the grip 12.

With reference to FIG. 4, the steering handle 1 is positioned such that its longitudinal axis C2 is angled with respect to the center line C1 of the outboard motor 2 as viewed from above. The operator can be positioned on the inner side of the steering handle 1. For example, the operator can be positioned above the steering assembly in FIG. 4.

This handle assembly 5 can be manufactured with a steering handle 1 having the low speed control switch 14. For example, the handle assembly 5 can have an integrated mounting structure configured to house at least a portion of the low speed control switch. In some embodiments, the mounting structure can be a boss configured to surround and house the low speed control switch. The boss can be integrally formed with the handle body 11. However, the low speed control switch 14 can be mounted to the steering handle 1 after market. A bracket or mounting structure can attach the switch 14 to the steering handle 1.

FIGS. 6 to 9 illustrate additional embodiments of a handle assembly 5, which may be generally similar to the embodiment illustrated in FIGS. 1 to 5, except as further detailed below. Where possible, similar elements in FIGS. 6 to 9 are identified with identical reference numerals in the depiction of the embodiment of FIGS. 1 to 5.

Figure 6:
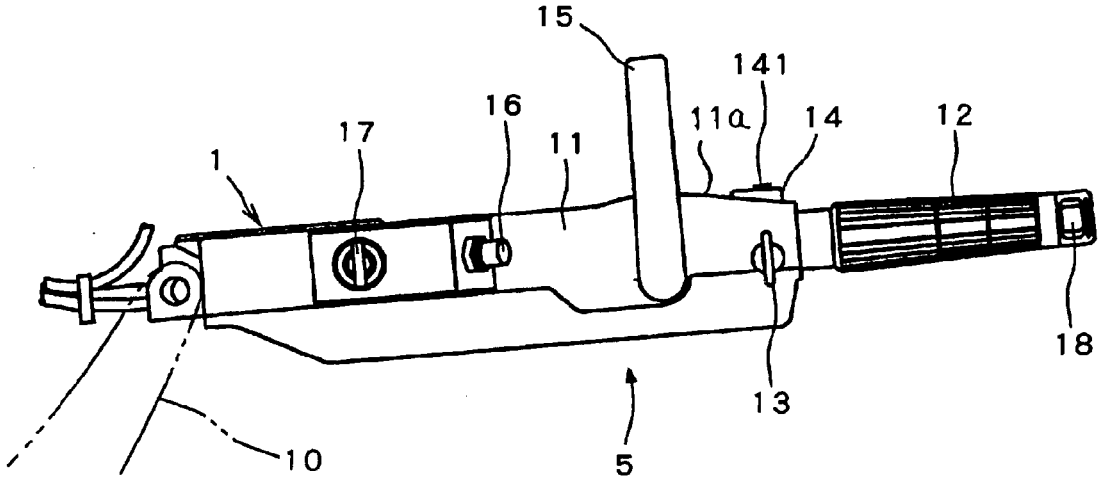
FIG. 6 is a side view of a steering handle assembly in accordance with another embodiment.
Figure 7:
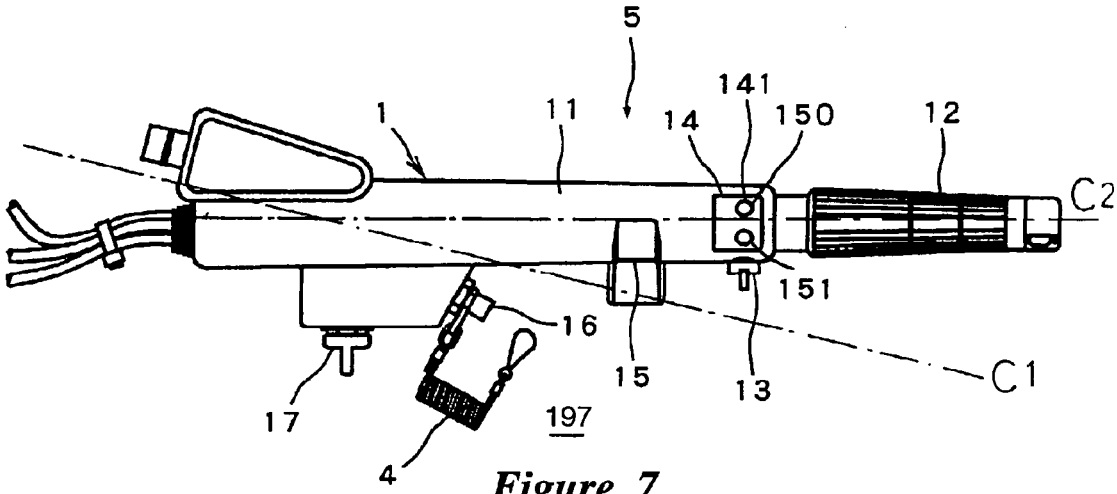
FIG. 7 is a top view of the steering handle assembly of FIG. 6.

With respect to FIGS. 6 and 7, the illustrated low speed control switch 14 is attached to the upper surface of the handle body 11. The switch 14 can be disposed next to the grip 12 and is preferably conveniently accessible so that the operator can easily use the switch 14 to adjust the engine speed. The low speed control switch 14 can include a plurality of switches or buttons. The low speed control switch 14 can be used to select a target low engine speed, such as a trolling speed. The illustrated low speed control switch 14 has an operating face 141 that comprises two push switches 150, 151 (FIG. 7). The operator can use the switches 150, 151 to input a desired target engine speed. When one of the switches is depressed, the engine speed is increased. When the other switch is pushed down, the engine speed is decreased. For example, the switch 150 can be depressed to increase the engine speed during trolling. The switch 151 can be depressed to decrease the engine speed. If neither switch 150, 151 is depressed, the engine speed is maintained at a generally constant speed. The switches 150, 151 can be connected to a corresponding lead wire 140 which, in turn, is connected to the controller 35. Preferably, the lead wires 140 pass through the inside of the handle body 11 to the controller 35.

As shown in FIG. 6, a slanting surface 11*a* is inclined downwardly in the distal direction and defines an upper surface of the handle body 11 of the steering handle 1. The illustrated slanting surface 11*a* is positioned between the shift lever 15 (illustrated in a vertical position) and the grip 12. The low speed control switch 14 is disposed along and extends vertically from the slanting surface 11*a* so that the switch 14 is easily accessible.

Because the operating face 141 of the low speed control switch 14 is near the grip 12, the operator can use one hand to operate the operating face 141 while holding the grip 12. That is, the low speed control switch 14 can be positioned close enough to the grip 12 so that a user can simultaneously engage both the grip 12 and the low speed control switch 14. Additionally, the low speed control switch 14 can be highly visible to facilitate convenient operation.

With reference to FIG. 7, the steering handle 1 can be positioned so that its longitudinal axis C2 is angled with respect to the center line C1 of the outboard motor 2, as view from above. Thus, the longitudinal axis C2 and the center line C1 do not lie in the same plane. The operator can be positioned on the inner side (e.g., on the inner side 197 of the steering assembly in FIG. 7 and on the inner side 199 of the handle assembly 5 in FIG. 9). The low speed control switch 14 can be positioned at any suitable point along the steering handle 1. For example, the control switch 14 can be positioned at one of the side surface, top surface, bottom surface, or any other surface of the handle body 11.

Figure 8:
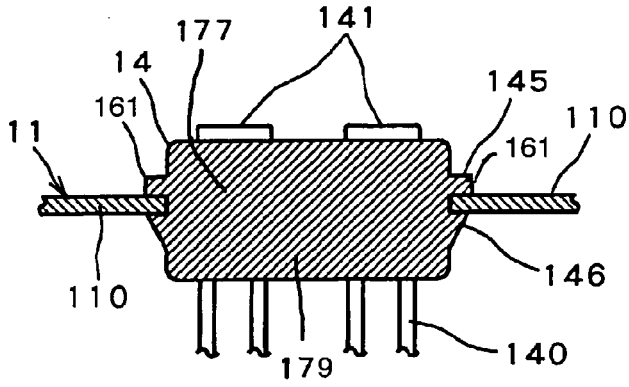
FIG. 8 is an enlarged vertical sectional view of a mounting portion of a low speed control switch of the steering handle assembly of FIG. 6.
Figure 9:
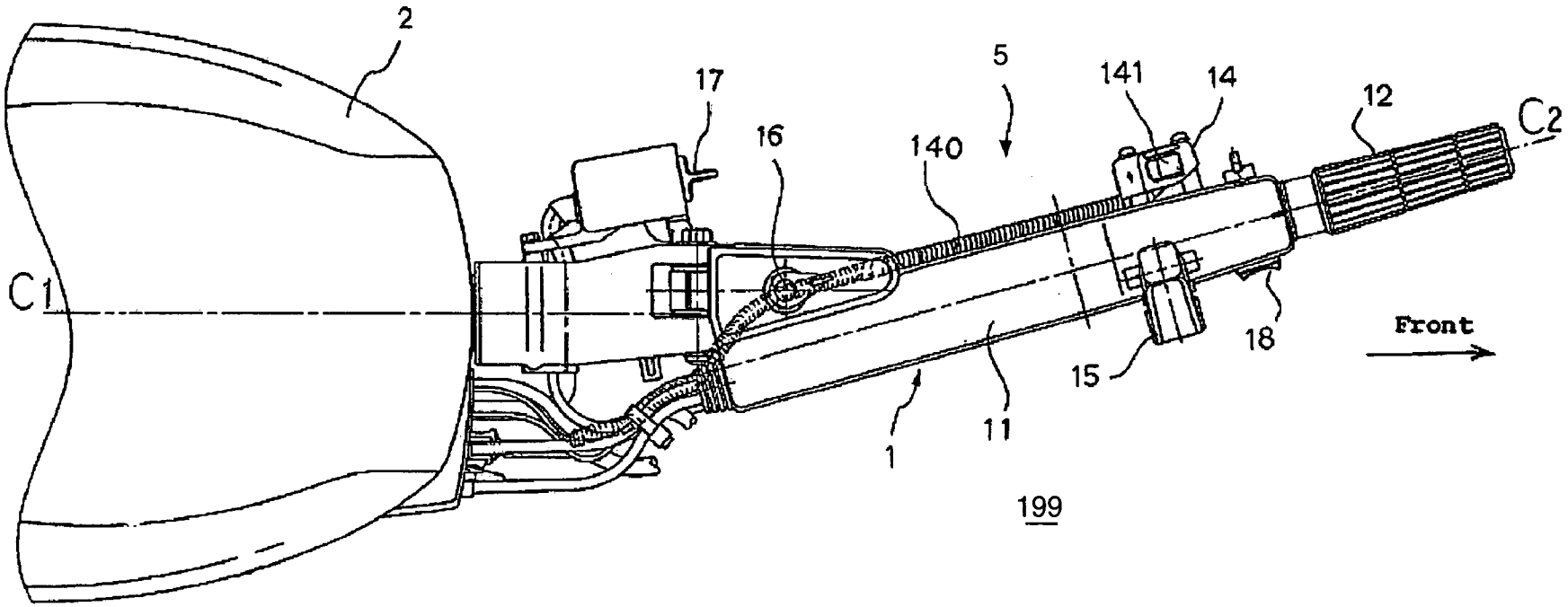
FIG. 9 is an illustration of a mounting angle between a steering handle assembly with respect to an outboard motor in accordance with another embodiment.

With respect to FIG. 8, a mounting structure 177 of the low speed control switch 14 is attached to the handle body 11. A projection 145 and a lug portion 146 are formed on the side surfaces of the low speed control switch 14, entirely or partly around the circumference thereof. The projection 145 and the lug portion 146 define a groove or slot 161. The side walls 110 of the handle body 11 are held securely in the grooves 161. To attach the switch 14 to the handle body 11, the lower part 179 of the low speed control switch 14 is pushed into a hole defined by the side walls 110 of the handle body 11. The lug portions 146 engage the side walls 110 as they are passed through the hole. The lug portions 146 can be elastically and/or plastically deformed when the low speed control switch 14 is installed. Preferably, most of the lug portions 146 are elastically deformed as they are passed through the hole and the shape of the lug portions 146 are substantially or entirely restored when the lug portions 146 are disposed below the corresponding side wall 110.

Thus, the low speed control switch 14 is coupled to the handle body 11 with the side walls 110 of the handle body 11 captured between the corresponding lug portions 146 and the projections 145. This mounting structure is applicable also to the embodiments of FIGS. 1–4. Thus, the low speed control switches described herein can be attached to the handle body 1 by using one or more of the following: mounting structure, screw fastener (see FIG. 4), and/or a push-in type arrangement (see FIG. 8).

With continued reference to FIG. 8, a plurality of lead wires 140 extends from the low speed control switch 14 to the controller 35. In the illustrated embodiment, the lead wires 140 are disposed in passageway extending through the handle body 11. The handle body 11 can protect and prevent damage to the lead wires 140. When the grip 12 is rotated, the lead wires 140 advantageously do not twist.

In operation, the grip 12 can be rotated to open the throttle valve 32 a desired amount. When the throttle valve 32 is closed by rotating the grip 12, trolling propulsion can be started. After the engine is running at a preset target trolling or idle speed, the switches 150, 151 can be used to adjust the air flow rate to the engine to thereby achieve a desired engine speed. To increase or decrease the engine speed, the operator presses on the switches 150, 151, respectively. The operator can operate the low speed control switch 14 while holding the grip 12, or without moving his hand a significant distance from the grip.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. For example, the embodiments disclosed herein can be used with other types of engines that operate at low speeds. Additionally, the steering handle assembly can be used with other types of air induction systems, such as "throttleless" induction systems. The embodiments can also be used with watercraft (e.g., personal watercraft), land vehicles, and the like. While a number of variations of the invention have been shown and described in detail, other modifications, which are within the scope of this invention, will be readily apparent to those of skill in the art based upon this disclosure. It is also contemplated that various combination or sub-combinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A steering handle assembly for an outboard motor having an engine, the steering handle assembly comprising an elongated handle body being connected to and extending from the outboard motor, a grip being mounted to a distal end of the handle body and being rotatable about a longitudinal axis of the handle body, a shift lever connected to the handle body, a low speed control switch configured to increase and decrease the rotational speed of the engine while the engine is operating at relatively low speeds, the low speed control switch being attached to the handle body, at least a portion of the low speed control switch being disposed between the shift lever and the grip and substantially near the grip, and a power trim and tilt switch for adjusting a trim angle and tilt angle of the outboard motor, the power trim and tilt switch being positioned on a side of the handle body with the low speed control switch positioned on another side of the handle body.

2. The steering handle assembly of claim 1, wherein the low speed control switch includes a housing and a drain hole extending through the housing, and the drain hole is positioned so as to discharge water contained in the switch.

3. The steering handle assembly of claim 1, further comprising a propeller that rotates about a propeller axis, wherein the steering handle assembly has a longitudinal axis that is angled with respect to the propeller axis as viewed from above.

4. The steering handle assembly of claim 1, wherein the low speed control switch comprises a plurality of buttons, each button being actuated to control the rotational speed of the engine.

5. The steering handle assembly of claim 4, wherein one of the buttons being actuatable to increase engine speed and another button being actuatable to decrease engine speed.

6. The steering handle assembly of claim 1, wherein the low speed control switch is positioned on a top side of the handle body.

7. The steering handle assembly of claim 1, wherein the low speed control switch is positioned on an opposite side of the handle body relative to the power trim and tilt switch.

8. A steering handle assembly for an outboard motor having an engine, the steering handle assembly comprising an elongated handle body being connected to and extending from the outboard motor, a grip being mounted to a distal end of the handle body and being rotatable about a longitudinal axis of the handle body, a shift lever connected to the handle body, and a low speed control switch configured to increase and decrease the rotational speed of the engine operating at relatively low speeds, the low speed control switch being attached to the handle body and comprising an operating face that is generally oriented horizontally and faces upwardly and generally normal to the longitudinal axis.

9. A steering handle assembly for an outboard motor having an engine, the steering handle assembly comprising an elongated handle body being connected to and extending from the outboard motor, a grip being mounted to a distal end of the handle body and being rotatable about a longitudinal axis of the handle body, a shift lever connected to the handle body, and a low speed control switch configured to increase and decrease the rotational speed of the engine while the engine is operating at relatively low speeds, the low speed control switch being attached to the handle body, a power trim and tilt switch disposed on one side of the steering handle, and the low speed control switch is disposed on an opposing side of the steering handle.

10. A steering handle assembly for an outboard motor having an engine, the steering handle assembly comprising an elongated handle body being connected to and extending from the outboard motor, a grip being mounted to a distal end of the handle body and being rotatable about a longitudinal axis of the handle body, a shift lever connected to the handle body, and a low speed control switch configured to increase and decrease the rotational speed of the engine while the engine is operating at relatively low speeds, the low speed control switch being attached to the handle body, wherein the grip is rotatable about the longitudinal axis and the low speed control switch is actuatable along an axis that lies obliquely or perpendicular with respect to the longitudinal axis.

11. A steering handle assembly for an outboard motor having an engine, the steering handle assembly comprising a handle body connected to the outboard motor, the handle body having a distal end and a proximal end, a grip being rotatably mounted to the distal end of the handle body, and a low speed control switch being configured to increase and decrease the rotational speed of the engine while the engine is operating at relatively low speeds, the low speed control switch being attached to the handle body near and proximal of the grip, and a power trim and tilt switch for adjusting a trim angle and tilt angle of the outboard motor, the power trim and tilt switch being positioned on a side of the handle body with the low speed control switch positioned on another side of the handle body.

12. The steering handle assembly of claim 11, further comprising a shift lever connected to the handle body, and at least a portion of the low speed control switch being positioned between the shift lever and the grip.

13. The steering handle assembly of claim 11, wherein the low speed control switch is spaced from the grip.

14. The steering handle assembly of claim 11, wherein at least one lead wire extends from the low speed control switch to a controller that is in communication with an air intake system of the outboard motor, and the grip is rotatable without twisting the leads.

15. The steering handle assembly of claim 11, wherein the grip is rotatable relative to the low speed control switch.

16. The steering handle assembly of claim 11, wherein the grip is rotatable about an axis without also rotating the low speed switch about a longitudinal axis of the grip.

17. The steering handle assembly of claim 11, wherein the low speed control switch is mounted to a side of the handle body.

18. The steering handle assembly of claim 11, wherein the low speed control switch is positioned on an upper surface of the handle body.

19. The steering handle assembly of claim 11, wherein the low speed control switch is positioned on one of a port or starboard sides of the handle body and the power trim and tilt switch is positioned on the other one of the port and starboard sides of the handle body.

20. An outboard motor comprising a steering handle assembly and an engine including an engine body, the engine body cooperating with at least one reciprocating piston to define at least one combustion chamber, an induction system configured to guide air to the combustion chamber through at least a pair of intake ports, at least one fuel injector configured to inject fuel for combustion in the combustion chamber, the steering handle assembly comprising a handle body, the handle body having a distal end and a proximal end, a grip being rotatably mounted to the distal end of the handle body, and a low speed control switch being configured to increase and decrease the rotational speed of the engine while the engine is operating at relatively low speeds, the low speed control switch being attached to the handle body proximal of the grip, and a power trim and tilt switch for adjusting a trim angle and tilt angle of the outboard motor, the power trim and tilt switch being positioned on a side of the handle body and the low speed control switch being positioned on another side of the handle body.

* * * * *